US005169751A

United States Patent [19]

Szücs et al.

[11] Patent Number: 5,169,751

[45] Date of Patent: Dec. 8, 1992

[54] PROCESS FOR THE CHEMICAL SENSITIZATION OF SILVER HALIDE PHOTOGRAPHIC EMULSIONS

[75] Inventors: Miklós Szücs, Budapest; Judit Csapláros; János Becsó, both of Vác; László Fenichel, Budapest; Péter Bakó, Budapest; László Töke, Budapest, all of Hungary

[73] Assignee: Forte Photochemical Industry, Vác, Hungary

[21] Appl. No.: 641,144

[22] Filed: Jan. 15, 1991

[30] Foreign Application Priority Data

Jan. 15, 1990 [HU] Hungary ..... 136/90

[51] Int. Cl.[5] ..... G03C 1/08

[52] U.S. Cl. ..... 430/600; 430/603; 430/605; 430/614; 430/612

[58] Field of Search ..... 430/600, 614, 603, 605, 430/612

[56] References Cited

U.S. PATENT DOCUMENTS 3,893,885 7/1975 Charkoudian ..... 430/600

4,255,512 3/1981 Nawn et al. ..... 430/614

4,752,560 6/1988 Benard et al. ..... 430/600

4,865,965 9/1989 Friour et al. ..... 430/600

*Primary Examiner*—Charles L. Bowers, Jr.

*Assistant Examiner*—Janet C. Baxter

*Attorney, Agent, or Firm*—Herbert Dubno; Jonathan Myers

[57] ABSTRACT

The invention relates to a novel process for the chemical sensitization of silver halide photographic emulsions.

The process according to the invention comprises adding as additional sensitizing agents a 40–260 μ moles/mole of a cyclic polyether containing 1 nitrogen and 5 oxygen atoms, or 2 nitrogen and 4 oxygen atoms, or 3 nitrogen and 3 oxygen atoms, or 4 nitrogen and 2 oxygen atoms as well as 12 carbon atoms and/or their complexes formed with gold and/or palladium and optionally 40–260 μ moles/mole of silver halide) of gold (I) or gold (III) sulfide to the sulfur-sensitized emulsion, and employing the cyclic polyether in relation to the noble metal salt in a molar ratio of 0.5:1–5:1 for the complex formation.

6 Claims, No Drawings

PROCESS FOR THE CHEMICAL SENSITIZATION OF SILVER HALIDE PHOTOGRAPHIC EMULSIONS

FIELD OF THE INVENTION

The invention relates to a process for the chemical sensitization of silver halide photographic emulsions by cyclic polyethers and/or their noble metal complexes.

BACKGROUND OF THE INVENTION

For the chemical sensitization of silver halide photographic emulsions, the combinations of labile sulfur and gold compounds are most widely used. The former ones develop on the crystal surfaces silver sulfide centers, from which mainly a gold sulfide or (gold, silver) sulfide arises under the effect of the gold compound. Thus, the sensitivity is increased, the fog is diminished, the reciprocity failure occurring under an illumination of high intensity is improved and the solarization is supressed. A useful labile sulfur compound is inter alia the thiosulfate whereas gold(I) and gold(III) complexes may be employed as gold compounds. [E. Moisar: Phot. Sci. Eng. 25, 45 (1981)].

Considering that gold(III) reacts with gelatin (which, according to most recent investigations, is due to methionine being present in the polypeptide chain), gold(I) complexes are preferred for gold sensitization. The gold(I) isothiocyanate complex formed by the interaction of $SCN^-$ and $AuCl_4^-$ ions, which is the result of an autoreduction in the presence of a high thiocyanate excess, has been used for a long time. Nevertheless, unfavorable properties of the emulsion may also be developed by its use, e.g.: a) the efficiency of sensitization is deteriorated by the chelate formation of gold(I) with gelatin; b) as a result of reducing substances of the gelatin, metallic gold arises which induces fogging; c) due to the thiocyanate being present in excess, a crystal increase occurs also during the chemical ripening whereby the covering ability is deteriorated and the image tone turns into grey in emulsions giving a brown one.

For eliminating these defects other gold compounds have been suggested, such as e.g. dithiosulfatemonoaurate(I) which though better adsorbed on silver halide crystals and having a stronger sensitizing effect, makes the sensitivity distribution strongly heterogeneous and therefore, it gives the possibility of preparing emulsions only with smooth gradation; in addition, depending on the sulfur sensitizer, it may induce fogging, too.

Various water-soluble and water-insoluble gold mercaptides, quaternary gold salts, gold sulfide, gold selenide and the like (U.S. Pat. Nos. 2,597,915, 2,642,361, 3,408,197 and 3,503,749) are also suitable for gold sensitization but their effect does not make the grade of gold thiocyanate or gold thiosulfate.

The supersensitization of sulfur- and gold-sensitized emulsions by palladium(II) salts has been described in the early 50's (U.S. Pat. No. 2,598,079). Nevertheless, the sensitivity was diminished by using $[PdCl_4]^{2-}$ together with gold thiosulfate; by using gold thiocyanate alone, the sensitivity was increased, however, the fog was also strengthened [L. De Brabandere and P. Faelens: Phot. Sci. Eng. 25, 63 (1981)]. The sensitivity of the emulsion treated with gold alone was significantly increased by the palladium(II) complexes of some N-alkylated polyamines but its value did not exceed those obtained by sulfur- plus gold-sensitization while the fogging was not changed When the suitable palladium(II) complex was added to a sulfur- plus gold-sensitized emulsion, the maximum sensitivity was not further increased, only the duration of ripening required for reaching the highest sensitivity was shortened whereas the fogging value remained unchanged [J. Hartung et al.: J. Inf. Rec. Mater. 14, 417 (1986)]. In addition to these, a part of the $Pd^{2+}$ introduced to the emulsion may also be lost for the sensitization due to the interaction of palladium(II) with gelatin [K. Tanaka: J. Phot. Sci. 21, 134 (1973)] depending on the stability of the palladium(II) complex used.

OBJECT OF THE INVENTION

Thus, the object of the invention is to develop a novel process of sensitization, by the means of which the sensitivity yield of methods known up to the present can be exceeded, a more narrow sensitivity distribution of the crystals can be achieved and other unfavorable effects can be eliminated.

SUMMARY OF THE INVENTION

The invention is based on the recognition that inclusion complexes are formed from gold or palladium ions with defined macrocyclic compounds.

The invention is further based on the recognition that 18-membered crown ethers containing oxygen and nitrogen, belonging to the macrocyclic compounds, are capable not only to form gold or palladium complexes but also to reduce noble metal ions of higher valence in the course of complex formation.

Furthermore, the invention is based on the recognition that, when used either separately or in combination, the complexes formed from the above-mentioned gold or palladium salts with macrocyclic compounds are capable of increasing the sensitivity of sulfur-sensitized crystals whereas a synergistic effect appears on their simultaneous use.

The invention is based on the further recognition that the reducing effect of the crown ethers mentioned also contributes to the increase in the sensitivity.

Finally, the invention is based on the recognition that an additional sensitivity increase results from the combination of the above-mentioned complexes of gold and palladium salts with gold sulfide.

Crown ethers are cyclic polyethers which are capable to include cations in their holes. The salt complexes are formed under the ion-dipole interaction of the cation with the heteroatoms (e.g. oxygen or nitrogen) being present in the polyether ring. The most important conditions required for the formation and factors influencing the stability of the complexes are: 1. relative dimensions of the ion and the hole being present in the polyether ring; 2. number and site of heteroatoms of the polyether cycle; 3. electrical charge of the ions and the like.

The formation of the complex is indicated by that: the solubility of both the polyether and salt is altered in various solvents; the UV spectrum of the polyether shows a characteristic change; and the conductivity of the salt solution is also altered [J. Pedersen: J. Am. Chem. Soc. 89, 7017 (1967)].

Although many hundreds of complexes have been described in the period elapsed from the preparation of the first crown ethers [R. M. Izatt et al.: Chem. Rev. 85, 271 (1985); I. Bernal: Stereochemical and Stereophysical Behaviour of Macrocycles, Elsevier, Amsterdam, pages 151, 161, 173–177 and 191–204 (1987)], no gold(I) compound has been reported and complexes of palladium formed only with 15- and 18-membered crown ethers containing sulfur, nitrogen and oxygen have been described. The former circumstance is related to that gold(I) is more likely to form stable linear complexes. Notwithstanding, our conductometric examinations have shown that a complex formation occurs by the interaction of 1,10-diaza-4,7,13,16-tetraoxacyclooctadecane and $HAuCl_4$, which has been supported by the strong decrease in the conductivity (Table 1).

TABLE 1

| Concentration of $HAuCl_4$ Moles/liter | Concentration of crown ether (CE) Moles/liter | [CE]/[Au] | Ω μS |
|---|---|---|---|
| $10^{-3}$ | — | — | 420 |
| $10^{-3}$ | $0.5 \cdot 10^{-3}$ | 0.5 | 245 |
| $10^{-3}$ | $1.0 \cdot 10^{-3}$ | 1 | 175 |
| $10^{-3}$ | $1.5 \cdot 10^{-3}$ | 1.5 | 105 |
| $10^{-3}$ | $3.0 \cdot 10^{-3}$ | 3 | 98 |
| $10^{-3}$ | $5.0 \cdot 10^{-3}$ | 5 | 7 |

In our opinion, the role of stability of complexes formed from noble metal salts with cyclic polyethers in the sensitization can be defined in such a way that the complex has to be sufficiently stable to prevent the interaction of the metal ions with gelatin and, on the other hand, it should be able to adsorb on the crystals and then to release the metal ion for the sensitization.

The reduction occurring in the course of complex formation, e.g. the conversion of $Au^{3+}$ to $Au^{+}$ was proven by oxidation-reduction potential measurements carried out with a Pt/calomel electrode pair (Table 2).

TABLE 2

| Concentration of $HAuCl_4$ Moles/liter | Concentration of Compound II Moles/liter | Oxidation-reduction potential at 25° C. mV |
|---|---|---|
| $10^{-4}$ | — | +393 |
| $10^{-4}$ | $10^{-4}$ | +210 |
| $10^{-4}$ | $2 \cdot 10^{-4}$ | +142 |
| $10^{-4}$ | $3 \cdot 10^{-4}$ | −38 |

In the process according to the invention an amount of 40–260 μmoles of a cyclic polyether containing 1 nitrogen 5 oxygen atoms, or 2 nitrogen and 4 oxygen atoms, or 3 nitrogen and 3 oxygen atoms, or 4 nitrogen and 2 oxygen atoms as well as 12 carbon atoms and/or their complexes formed with gold and/or palladium are used for an additional sensitization per mole of sulfur-sensitized silver halide photographic emulsions while employing the cyclic polyether and the noble metal salt in an 0.5:1–5:1 molar ratio.

According to an other embodiment of the process of the invention a 40–260 μmoles of gold(I) sulfide or gold(III) sulfide are also used per mole of silver halide in addition to the cyclic polyether and/or its complex(es) formed with gold and/or palladium for the sensitization.

Polyethers, being useful in the process of the invention, are e.g.

Monoazapentaoxacyclooctadecane of the formula (I)

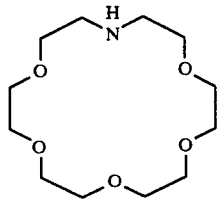

(I)

1,10-diaza-4,7,13,16-tetraoxacyclooctadecane of the formula (II),

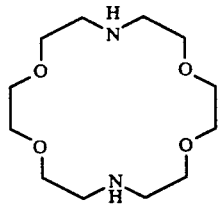

(II)

1,7-diaza-3,10,13,16-tetraoxacyclooctadecane of the formula (III)

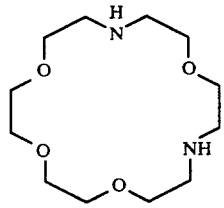

(III)

1,7,13-triaza-4,10,16-trioxacyclooctadecane of the formula (IV)

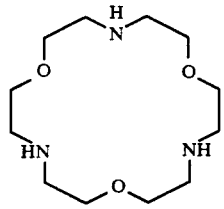

(IV)

and 7,16-dioxa-1,4,10,13-tetraazacyclooctadecane of the formula (V)

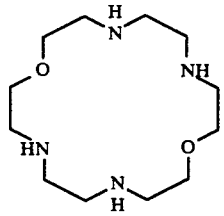

(V)

For carrying out the process of the invention, the inclusion complex is prepared by introducing the required amount of an aqueous solution containing the noble metal salt to a solution of the cyclic polyether in an organic solvent, e.g. methanol or ethanol. Useful noble metal ions or compounds are e.g. $[AuCl_4]^{-1}$, $[Au(SCN)_2]^-$, $[PdCl_6]^{2-}$, $[PdCl_4]^{2-}$, $PdCl_2$, $[Pd(SCN)_4]^{2-}$ and the like.

The advantages of the process according to the invention may be summarized as follows:

1) The efficiency of sensitization can significantly be increased in comparison to the sensitizing processes using noble metals known until now.
2) The tendency to fogging is diminished.
3!) The sensitivity can be strengthened without any decrease in the gradation.

The process according to the invention is illustrated in detail by the following non-limiting Examples.

EXAMPLE 1

500 g of an Ag(Br,Cl) emulsion (with an inert gelatin content of 8%, crystal size of 170 nm, variation coefficient of 20% and chloride excess of 30 mole %) are subjected to a chemical ripening at 55° C. In the 0. minute of the ripening 85 μmoles of the sulfur sensitizer, i.e. the complex of phenylrhodanine with carboxymethyl-β-cyclodextrin polymer (M. Szucs et al., United Kingdom patent specification No. 2,160,993), per mole of silver halide are added to the emulsion, then other chemical sensitizers respectively are added fifteen minutes later as indicated in Table 3 and the chemical ripening is continued at the same temperature for an additional 85 minutes. After cooling down, 2 ml of a 0.05% solution of 3,3'-diethyl-1'-phenylbenzoxazylidene-ethylidene-2'-thiohydantoine, 2 ml of 50% glycerol solution, 5 ml of 4% saponin solution, 5 ml of 8% 2-hydroxy-4,6-dichloro-s-triazine solution and 1 ml of a 1% phenylmercaptotetrazole solution are added at 40° C. to 100 g of the above emulsion. Thereafter, the emulsion is applied on a baryta-coated paper base with a surface silver content of 1.15±0.05 g/m².

For plotting the characteristic curve, the photographic material is illuminated through a photographic modulator by a lamp with a color temperature of 2850° K and then developed at 18° C. for 2 minutes in a developer containing 1 g or methol, 4 g of hydroquinone, 20 g of anhydrous sodium sulfite, 10 g of anhydrous sodium carbonate and 1 g of potassium bromide in 1 liter of water.

The results are shown in Table 3. It is obvious from this table that gold complexes of cyclic polyethers used in the process according to the invention exert a higher sensitizing effect with lower fogging values than other gold compounds do and, in addition, they give a higher gradation.

It can also be stated that cyclic polyethers, even when used alone and mainly in higher doses, possess a significant sensitizing effect while resulting a lower gradation and eventually a somewhat higher fogging value than their gold complexes do.

TABLE 3

| Other sensitizers | | | | | | |
|---|---|---|---|---|---|---|
| Name | Dose μ moles/mole of silver halide | $S_{rel}$ | $\bar{G}$ | $D_o$ 18° C., 2 min | $D_o$ 30° C., 5 min |
| None | — | 100 | 2.04 | 0.05 | 0.26 |
| $[Au(SCN)_2]^-$ | 85 | 165 | 1.90 | 0.09 | 0.37 |
| $[Au(S_2O_3)]^-$ | 85 | 178 | 1.35 | 0.08 | 0.29 |
| $Au_2S_3$ | 85 | 145 | 1.80 | 0.08 | 0.30 |
| Compound (II) | 150 | 120 | 1.68 | 0.06 | 0.21 |
| | 200 | 160 | 1.75 | 0.07 | 0.25 |
| | 255 | 200 | 1.80 | 0.08 | 0.27 |
| Gold complex of | 42.5 | 206 | 2.01 | 0.06 | 0.16 |
| compound (II) | 85 | 239 | 2.11 | 0.06 | 0.22 |
| [(II)]/[Au] = 3 | 127.5 | 256 | 2.10 | 0.06 | 0.30 |
| | 170 | 191 | 1.96 | 0.08 | 0.32 |
| Gold complex of compound (II) | | | | | |
| [(II)]/[Au] = 0.5 | 85 | 169 | 1.93 | 0.06 | 0.20 |
| 1.5 | 85 | 188 | 2.06 | 0.06 | 0.20 |
| 3 | 85 | 239 | 2.11 | 0.06 | 0.22 |
| 5 | 85 | 200 | 2.05 | 0.09 | 0.22 |
| Compound (IV) | 150 | 132 | 1.52 | 0.08 | 0.22 |
| | 200 | 196 | 1.60 | 0.08 | 0.28 |
| | 255 | 216 | 1.62 | 0.08 | 0.30 |
| Gold complex of | 42.5 | 200 | 1.90 | 0.07 | 0.24 |
| compound (IV) | 85 | 219 | 1.98 | 0.08 | 0.27 |
| [(IV)]/[Au] = 3 | 127.5 | 226 | 2.07 | 0.08 | 0.30 |
| Gold complex of | 42.5 | 190 | 1.50 | 0.09 | 0.28 |
| compound (V) | 85 | 211 | 1.58 | 0.09 | 0.32 |
| [(V)]/[Au] = 1.5 | 127.5 | 215 | 1.58 | 0.09 | 0.36 |

EXAMPLE 2

The process described in Example 1 is followed, except that gold sulfide is added 10 minutes after the ripening and 25 minutes after the ripening, the gold complex of Compound (II) ([(II)]/[Au]=3) is introduced to the emulsion. The results are summarized in Table 4.

TABLE 4

| Gold sulfide | | Addition | | | | |
|---|---|---|---|---|---|---|
| Composition | Dose moles/mole of silver halide | of complex moles/mole of silver halide | $S_{rel}$ | $\bar{G}$ | $D_o$ 18° C., 2 min | $D_o$ 30° C., 5 min |
| $Au_2S_3$ | 0 | 0 | 100 | 2.04 | 0.05 | 0.22 |
| | 85 | 85 | 270 | 2.10 | 0.05 | 0.28 |
| | 170 | 85 | 318 | 2.15 | 0.06 | 0.32 |
| | 255 | 85 | 330 | 2.18 | 0.06 | 0.34 |
| $Au_2S$ | 127.5 | 0 | 180 | 2.32 | 0.06 | 0.32 |
| | 127.5 | 42.5 | 232 | 2.38 | 0.07 | 0.36 |
| | 127.5 | 85 | 279 | 2.40 | 0.07 | 0.38 |

TABLE 4-continued

| Composition | Gold sulfide Dose moles/mole of silver halide | Addition of complex moles/mole of silver halide | $S_{rel}$ | $\bar{G}$ | $D_o$ 18° C., 2 min | $D_o$ 30° C., 5 min |
|---|---|---|---|---|---|---|
| | 127.5 | 127.5 | 302 | 2.35 | 0.09 | 0.39 |

It is clearly shown by the results that in comparison to the emulsion containing a sulfur sensitizer alone, the sensitivity can further be increased by using a combination of gold complex of the cyclic polyether with gold sulfide.

EXAMPLE 3

500 g of an Ag(Br,Cl) emulsion (with an inert gelatin content of 9.1%, iodide content of 0.9 mole %, pBr=3.0, crystal size of 425 nm, variation coefficient of 25%) are subjected to a chemical ripening at 63° C. In the 0. minute of the ripening 50 μ moles/mole of silver halide of the sulfur sensitizer (see Example 1), in the 15th minute $Au_2S_3$, in the 20. minute gold complex are added and the chemical ripening is continued at the same temperature for additional 100 minutes. After cooling down, 1.5 ml of an 50% glycerol solution, 5.8 ml of an 8% 2-hydroxy-4,6-dichloro-s-triazine solution, 5 ml of 4% saponin solution and 2.5 ml of 1% 4-hydroxy-6-methyl-1,3,3*a*,7-tetraazaindole solution are added at 40° C. to 100 g of the above solution. Thereafter, the emulsion is applied onto a cellulose triacetate base with a surface silver content of 3.0±0.15 g/m². The sensitometric characteristics are determined according to the ANSI PH 2.5-1972 standard (with a developing time of 7 minutes). The results are summarized in Table 5.

TABLE 5

| Dose of $Au_2S_3$ moles/mole of silver halide | Gold complex or other sensitizers Name | Dose moles/mole of silver halide | $S_{rel}$ | $\bar{G}$ | $D_o$ |
|---|---|---|---|---|---|
| 0 | — | — | 100 | 0.60 | 0.11 |
| 0 | Compound (I) | 150 | 135 | 0.58 | 0.10 |
| | | 200 | 150 | 0.59 | 0.12 |
| | | 250 | 162 | 0.61 | 0.14 |
| 0 | Compound (III) | 150 | 151 | 0.63 | 0.15 |
| 25 | $[Au(SCN)_2]^-$ | 50 | 150 | 0.62 | 0.08 |
| 25 | $[Au(S_2O_3]^-$ | 50 | 159 | 0.58 | 0.12 |
| 25 | Gold complex of | 25 | 198 | 0.63 | 0.10 |
| | compound (I) | 50 | 212 | 0.62 | 0.11 |
| | [(I)]/[Au] = 1.5 | 100 | 230 | 0.64 | 0.13 |
| 50 | Gold complex of | 25 | 180 | 0.56 | 0.09 |
| | compound (III) | 50 | 192 | 0.58 | 0.11 |
| | [(III)]/[Au] = 3 | 100 | 201 | 0.61 | 0.12 |

It is shown by the data that the combinations of gold complexes of cyclic polyethers with gold sulfide ensure a higher sensitivity increase than the usual gold complexes.

EXAMPLE 4

The process described in Example 1 is followed, except that the sulfur sensitizer is added in an amount of 100 μ moles/mole of silver halide and minutes after its addition additive A, 10 minutes after additive B, 15 minutes after additive C are added to the emulsion. The results obtained are illustrated in Table 6.

TABLE 6

| A | μ moles/mole of silver halide | B | μ moles/mole of silver halide | C | μ moles/mole of silver halide | $S_{rel}$ | $\bar{G}$ | $D_o$ 18° C., 2 min | $D_o$ 30° C., 5 min |
|---|---|---|---|---|---|---|---|---|---|
| 0 | | 0 | | 0 | | 100 | 2.30 | 0.04 | 0.20 |
| C1 | 127.5 | C2 | 85 | — | | 221 | 2.18 | 0.06 | 0.24 |
| | 127.5 | | 170 | — | | 280 | 2.21 | 0.06 | 0.25 |
| | 127.5 | | 255 | — | | 312 | 2.16 | 0.06 | 0.24 |
| C2 | 85 | — | | — | | 169 | 2.39 | 0.07 | 0.20 |
| | 170 | — | | — | | 173 | 2.40 | 0.07 | 0.21 |
| | 255 | — | | — | | 178 | 2.35 | 0.08 | 0.22 |
| C3 | 127.5 | C2 | 127.5 | — | | 230 | 2.26 | 0.06 | 0.24 |
| | 170 | | 127.5 | — | | 272 | 2.19 | 0.08 | 0.25 |
| | 255 | | 127.5 | | | 306 | 2.06 | 0.08 | 0.28 |
| C1 | 85 | C3 | 85 | C2 | 85 | 325 | 2.26 | 0.08 | 0.32 |
| | 85 | | 85 | | 170 | 356 | 2.21 | 0.09 | 0.34 |
| | 85 | | 85 | | 255 | 365 | 2.28 | 0.08 | 0.33 |

Notes to Table 6:
C1: Gold complex of Compound (II), [(II)]/[Au] = 1.5
C2: the complex of Compound (II) with $(NH_4)_2PdCl_4$, [(II)]/[Pd] = 1.5
C3: $Au_2S$ It is obvious from the above results that the palladium complex of Compound (II) in sulfur-sensitized emulsion ensures the same grade of sensitivity increase as the gold complex does and, on the other hand, the combination of palladium(II) and gold(I) complexes permits a higher sensitivity increase than these do separately in the same doses. It is also obvious that the combination of the palladium complex with gold sulfide also results in a significant sensitivity increase.

We claim:

1. A process for increasing the chemical sensitization of sulfur-sensitized silver halide photographic emulsions, which comprises adding as a sensitizing agent, 40–260 μmoles/mole of silver halide of a cyclic polyether containing 12 carbon atoms and containing 1 nitrogen and 5 oxygen atoms, or 2 nitrogen and 4 oxygen atoms, or 3 nitrogen and 3 oxygen atoms, or 4 nitrogen and 2 oxygen atoms, or a complex of the cyclic polyether formed with a gold or palladium salt and optionally adding 40–260 μ moles of gold(I) or gold(III) sulfide per mole of silver halide to the sulfur-sensitized silver halide emulsion, and employing the cyclic polyether in relation to the gold or palladium salt in a molar ratio of 0.5:1–5:1 for the complex formation.

2. A process as claimed in claim 1, which comprises using a monoazapentaoxacyclooctadecane as the cyclic polyether.

3. A process as claimed in claim 1, which comprises using 1,10-diaza-4,7,13,16-tetraoxacyclooctadecane as the cyclic polyether.

4. A process as claimed in claim 1, which comprises using 1,7-diaza-3,10,13,16-tetraoxacyclooctadecane as the cyclic polyether.

5. A process as claimed in claim 1, which comprises using 1,7,13-triaza-4,10,16-trioxacyclooctadecane as the cyclic polyether.

6. A process as claimed in claim 1, which comprises using 7,16-dioxa-1,4,10,13-tetraazacyclooctadecane as the cyclic polyether.

* * * * *